US005514079A

United States Patent [19]

Dillon

[11] Patent Number: 5,514,079

[45] **Date of Patent: *May 7, 1996**

[54] METHOD FOR PROMOTING CIRCULATION OF BLOOD

[76] Inventor: Richard S. Dillon, 150 Mill Creek Rd., Ardmore, Pa. 19003

[21] Appl. No.: 180,635

[22] Filed: Jan. 13, 1994

[ * ] Notice: The term of this patent shall not extend beyond the expiration date of Pat. No. 5,279,283.

Related U.S. Application Data

[63] Continuation-in-part of Ser. No. 928,499, Aug. 11, 1992, Pat. No. 5,279,283.

[51] Int. Cl.[6] ..... A61H 9/00

[52] U.S. Cl. ..... 601/151; 601/150; 128/DIG. 20

[58] Field of Search ..... 128/703, 707, 128/DIG. 20; 601/150, 151, 152

[56] References Cited

U.S. PATENT DOCUMENTS

| | | | |
|---|---|---|---|
| 3,835,845 | 9/1974 | Maher . | |
| 3,961,625 | 6/1976 | Dillon . | |
| 4,077,402 | 3/1978 | Benjamin, Jr. et al. . | |
| 4,269,175 | 5/1981 | Dillon . | |
| 4,343,302 | 8/1982 | Dillon . | |
| 4,420,000 | 12/1983 | Bailey | 128/706 |
| 4,753,226 | 6/1988 | Zheng et al. . | |
| 5,000,164 | 3/1991 | Cooper . | |
| 5,007,411 | 4/1991 | Dye | 601/151 |
| 5,092,317 | 3/1992 | Zelikovski | 601/152 |
| 5,279,283 | 1/1994 | Dillon . | |

OTHER PUBLICATIONS

W. Lawson et al., The American Journal of Cardiology, 70: 859–862 (1992).

H. Soroff et al., Critical Care Clinics, 2: 277–295 (1986).

A. Solignac et al., Catheterization and Cardiovascular Diagnosis, 3: 37–45 (1977).

X. Yu–Yun et al., Chinese Medical Journal, 103: 768–771 (1990).

Z. Zheng et al., Trans. Am. Soc. Artif. Intern. Organs, 29: 599–603 (1983).

Richard S. Dillon, Journal of Clinical Engineering, pp. 63–66, Jan.–Mar., 1980.

Amsterdam et al., Adances in Heart Disease, vol. 1, pp. 1–10, Grune & Stratton, New York, N.Y. (1977).

*Primary Examiner*—Richard J. Apley

*Assistant Examiner*—Jeanne M. Clark

*Attorney, Agent, or Firm*—Janet E. Reed; Dann, Dorfman, Herrell & Skillman

[57] ABSTRACT

The present invention provides a method and apparatus for improving the circulation of blood through a patient's heart and extremity. The method comprises applying external positive regional pressure on an extremity synchronously with the patient's heartbeat. An adjustable timing cycle is initiated at the QRS complex of the arterial pulse cycle. The timing cycle is based on an average time period between QRS complexes, which is calculated from a measurement of several successive QRS complexes in the patient's heart rate. Pressure pulses are applied in the end-diastolic portion of the arterial pulse cycle to reinforce the pulse that forces blood into the extremity. The pressure is then relieved prior to the next projected QRS complex to enable the next pulse to enter the extremity without undue obstruction, thereby promoting circulation of blood through the extremity. To promote circulation of blood through the heart, compression of the extremity is released shortly before the next projected QRS complex.

12 Claims, 1 Drawing Sheet

FIG. 1
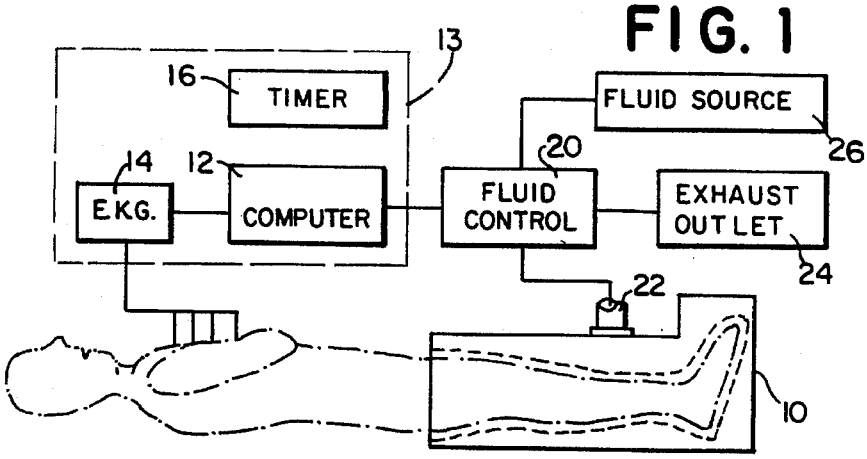
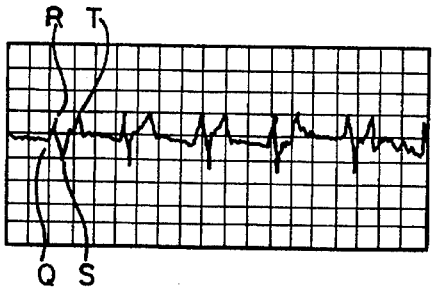
FIG. 2
FIG. 3
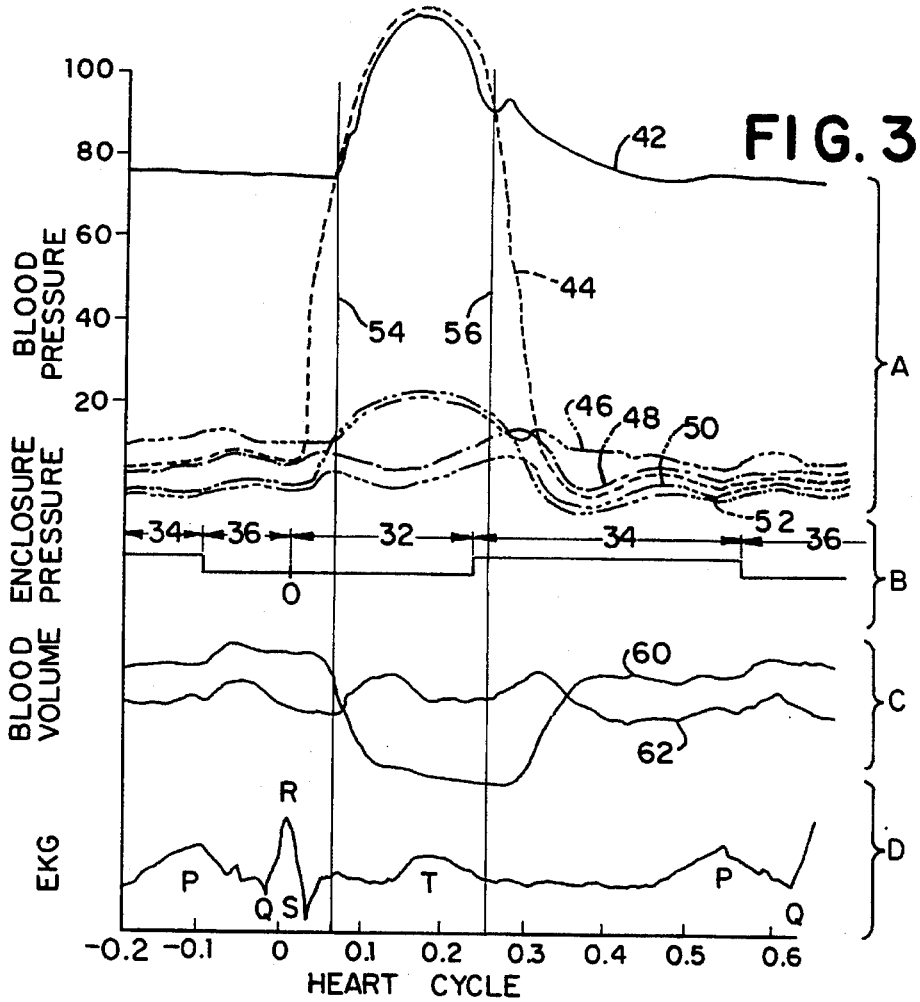

METHOD FOR PROMOTING CIRCULATION OF BLOOD

This application is a continuation-in-part of U.S. application Ser. No. 07/928,499, filed Aug. 11, 1992, now U.S. Pat. No. 5,279,283 on Jan. 18, 1994.

FIELD OF THE INVENTION

The present invention relates to a method for improving the circulation of blood, and more particularly to a method for improving the circulation of blood through a patient's heart and extremity.

BACKGROUND OF THE INVENTION

For the treatment of various diseases, it is often helpful to enhance the patient's natural blood circulation. It is particularly desirable to promote blood circulation in the treatment of ischemic diseases occurring in the extremities of limbs of the body. By artificially promoting blood circulation, the development of ischemic lesions on a patient's extremities may be curtailed and ischemic lesions that have already developed may be healed. Artificial promotion of blood circulation may also be used in the treatment of coronary heart disease, where it can be utilized to reduce myocardial ischemia and support left ventricle function, thereby increasing coronary artery perfusion and myocardial oxygen supply while reducing cardiac oxygen demand and work.

A non-invasive means of enhancing a patient's natural blood flow involves the use of devices which apply and remove pressure from at least a portion of the patient's extremity. For example, a patient's legs may be enclosed in air bags which may be inflated to apply pressure on the leg and deflated to remove pressure from the leg. Synchronous application of pressure on an extremity can enhance the flow of blood into the extremity, as well as enhancing the pumping of blood through the heart.

Intermittent compression of an extremity can improve the circulation in several ways. First, it facilitates return of interstitial fluid, i.e., lymph fluid or edema, from the extremities. Second, it facilitates venous return. If the venous valves are intact, venous back pressure on the capillary bed in the extremity is reduced to zero, thereby improving the arterial-venous gradient. Both of these actions may increase volume return to the heart, and neither is dependent upon timing the leg compression with the end-diastolic portion of the heartbeat.

End-diastolic intermittent pressure to an extremity provides several additional advantages, however. The first is the promotion of arterial flow in an ischemic extremity, such as a leg. The blood pulse wave is allowed to enter the leg, and compression provides a driving force to disseminate the blood through the tissues. Moreover, timing of compression with the end-diastolic portion of the heart cycle tends to augment the wave form that is reflected back from the compressed extremity. In a resting patient, the normal pulse wave that enters a leg, for example, wells up and is reflected backward toward the heart. Properly timed end-diastolic pumping applies pressure in addition to the normal pulse waves in the leg, which both disseminates blood in the leg and augments the reflected wave form. This augmentation of the reflected wave form can increase splanchnic, renal and coronary flow.

Properly timed end-diastolic pressure also has the potential of promoting aortic pulse wave harmonics. Decompressing the extremity in the presystolic phase of the heart cycle functions to drop the pressure in the inflatable enclosure, thereby creating a negative pressure gradient that effectively augments the reflected wave form from the aortic valve in presystole and decreases cardiac afterload. The diastolic timing of the compressions and their release in presystole thus augments normal pressure waves and allows the compression device to effectively operate at comfortable pressures, such as 55–70 mm Hg. Thus, end-diastolic intermittent pressure on an extremity has several positive effects on cardiac function. First, in preload phase, the blood returning to the heart from the peripheral circulation has a greater momentum, thereby enabling more efficient loading of the heart without as much work. Second, the decrease in afterload allows more complete emptying of the heart, thereby allowing the ejection fraction and cardiac output to increase, while decreasing heart work.

Intermittent external pressure on the extremity, when timed to the end-diastolic portion of the heart cycle has significant positive clinical effects. For example, patients may be relieved of heart failure. Their pulmonary edema may be relieved and their serum lactate/pyruvate ratio reduced. Patients with septic shock and lactic acidosis may also experience reduced blood lactate levels. Those patients with a murmur due to insufficiency of the mitral valve are found to have a decrease in the intensity of their murmur as more blood enters the aorta and legs, rather than being returned to the left atrium. Urinary output commonly increases in patients with prerenal azotemia. An increase in cardiac output per heartbeat is associated with a reflex slowing of the pulse rate in both sick and normal patients.

The observed effect of rescuing patients from acute myocardial infarction has been hypothesized to result from several factors. First, as described earlier, the work of the heart and its oxygen requirements are decreased when properly-timed intermittent compression of an extremity is applied. The observed increased ejection fraction of the heart probably signifies that stunned heart muscle is again contracting, thereby resuming the work of pumping blood. Additionally, intermittent compression of an extremity stimulates the formation of fibrinolysins in the blood, which may aid in dissolving coronary clots. Thus, the augmentation of preload and decrease in afterload can increase muscle contractions, mechanically moving and possibly squeezing the coronary arteries. This action, together with the stimulation of fibrinolysins, can help restore patency to coronary arteries blocked with thrombus.

To this end, U.S. Pat. Nos. 3,961,625, 4,269,175, 4,343,302 and 4,590,925 to the present inventor disclose methods and apparatus to provide end-diastolic intermittent pressure to one or more extremities. The above-referenced patents emphasize a unique timing that relates compressions of the extremity to the occurrence of the QRS complex in the EKG tracing, which represents electrical systole for the ventricles.

With respect to timing compression of the extremity to promote blood flow through the extremity, the time delay from the QRS complex to the entry of the blood pulse into the extremity must be taken into account. The application of pressure is typically set at a pre-determined variable interval after the QRS complex, and the release of pressure may be set at a pre-determined variable interval after application of the pressure, or it may be triggered by the next QRS complex.

The timing of application of pressure depends on the pulse rate of the patient and on the size of the extremity. Compression is preferably applied as late as possible in the diastolic portion of the heart cycle. However, because the pressure in the air bag must overcome the inertia of blood in the extremity, the time of inflation of the air bag must be sufficiently long to overcome this inertia. For circulation-promoting systems such as that described in U.S. Pat. No. 4,343,302, a compression time of no less than 0.34 seconds is necessary.

Thus, an intermittent external compression system, in order to provide effective promotion of circulation through an extremity, is regulated by a timing cycle comprising a time delay (time necessary from the QRS complex for the subsequent pulse wave to reach the extremity) and a compression period (time which the extremity is compressed to facilitate movement of the blood through the extremity). The compression period should be calculated and set on the basis of the size of the extremity, and the time delay should compensate for movement of the pulse from the heart to the extremity. Current systems accomplish this either by presetting the time delay and the compression period, so that the sum of the two is approximately equal to the time between QRS complexes, or by manually adjusting the time delay to take into account changes in heart rate. Neither of these current methods is adequate to assure effective pumping of blood through the extremities of patients having either a very rapid and/or an irregular heart rate, nor can they compensate for the normal slowing of the heart rate that accompanies intermittent pressure therapy. Currently, no method is available for adjusting the timing cycle to better coincide with QRS complexes of patients with variable heart rates. Clearly, in order for external intermittent pressure therapy to be fully effective in such cases, such a method is needed.

With respect to promoting the flow of blood through the heart, the timing of pressure and release on the extremity again is important. The first fraction of mechanical systole is an isometric contraction in which the muscle tightens around the contained blood, raising the pressure within the ventricle from a low level to the level of diastolic blood pressure. When the intraventricular pressure reaches diastolic blood pressure, the aortic valve opens and blood begins to leave the ventricle, as the ventricular chamber actually decreases in size. Electrical systole, hence, precedes the first movement of blood from the ventricles by approximately 0.05 seconds. Peak ventricular outflow occurs approximately 0.1 seconds later, or 0.15 seconds after the QRS complex occurs. Blood ejection from the ventricles ends with the closure of the aortic valve, which follows the QRS complex by about 0.24 seconds. Assuming that pulse waves from the extremity to the heart travel at approximately 20–40 feet per second (the rate at which they would travel in water, a noncompressible medium), the drop in pressure caused by release of compression on the extremity is perceived by the heart within approximately 0.1–0.15 seconds. In view of the fact that blood ejection from the ventricles takes approximately 0.24 seconds after the QRS complex, if the extremity is decompressed at the next QRS complex, and 0.1–0.15 seconds pass before the drop in pressure is perceived by the heart, the drop in aortic blood pressure due to the release of the extremity is perceived by the heart for perhaps only the last ⅔ of the systole. To facilitate complete unloading of the heart, however, it would be preferable if pressure to the extremity were released before the next occurring QRS complex, so that the drop in pressure perceived by the heart occurs for the entire duration of systole. This could be accomplished by triggering the decompression of the air bag either by the "P" wave (atrial systole), or by manually anticipating occurrence of the next QRS complex and triggering deflation of the air bag approximately 0.02–0.1 seconds earlier. The use of the "P" wave is limited to those patients having "p" waves. Patients with atrial fibrillation have no "P" waves.

Thus, promotion of blood circulation through the heart involves precise timing of decompression of the extremity to occur shortly (e.g., 0.02–0.1 seconds) before the next occurring QRS complex. Manual adjustment of the time delay, which is the method currently available to regulate compression and decompression with the QRS complex, is clearly a cumbersome and inadequate means to precisely control decompression of the extremity to enable complete unloading of the heart. Patients with rapid or irregular heart rates are particularly disadvantaged because it is extremely difficult to continuously adjust compression and decompression of the extremity to coincide with a particular instant in the QRS cycle. In promoting pumping of blood through the heart and through an extremity, then, a method of adjusting compression and decompression of the air bag would indeed be a marked improvement over the methods currently available.

SUMMARY OF THE INVENTION

In accordance with the present invention, a method is provided for promoting the circulation of blood through a patient's extremity. In one aspect of the invention an inflatable enclosure, such as an air bag, is applied to an extremity (e.g., leg), so that upon inflation and deflation of the air bag, the extremity is alternately compressed and decompressed. Compression and decompression of the extremity is regulated by sensing the QRS complex in the heart cycle of the patient, computing an average time period between a selected number of successive QRS complexes, and initiating a timing cycle for compressing and decompressing the extremity.

The timing cycle is based on the average time period between sensed QRS complexes. The timing cycle (sometimes referred to herein as Th) is comprised of an adjustable time delay (Td) and a compression period (Tc), and is initiated at the occurrence of a QRS complex. The air bag is inflated at the conclusion of the time delay following the initiation of the timing cycle, thereby compressing the extremity. Inflation is maintained over the compression period; then the air bag is vented to initiate deflation at the conclusion of the compression period.

The duration of the time delay and the compression period are controlled relative to the average time period between QRS complexes, so as to avoid inflating the air bag during the occurrence of a QRS complex. This method offers the notable advantage of coinciding the release of pressure on the extremity with the QRS complex, so that the wave form generated by the heart may enter the extremity unobstructed. Since the timing cycle is adjustable, being based on a selected number of prior successive QRS complexes, compression on the extremity is released before the next QRS complex even if the pulse rate changes. Thus, even patients having an irregular heart rate may benefit from this method of promoting circulation of blood.

According to another aspect of the invention, instead of adjusting the timing cycle so that the compression period ends at the occurrence of the next QRS complex, the timing cycle is set so that the compression period ends shortly, e.g. 0.02–0.10 seconds, prior to the occurrence of the next QRS complex (i.e., in the last third of the heart cycle). This adjustment confers the additional benefit of promoting blood flow through the heart, as well as through the extremity, by allowing the drop in pressure in the extremity to reach the base of the heart, thereby enabling complete blood ejection from the ventricles. If decompression is not effected until the actual occurrence of the next QRS complex, even though blood flow is promoted through the extremity, optimum flow of blood through the heart is not accomplished.

According to another aspect of the present invention, an apparatus is provided for promoting circulation of blood through a patient's heart and extremity. The apparatus includes an inflatable legging having a fully enclosed boot for compressing the extremity, a fluid supply means for the legging for supplying a fluid, such as air, to the legging to inflate it, thereby compressing the extremity, an exhaust means for the legging, to deflate the legging and decompress the extremity, and a control means for the fluid supply and exhaust means to control the compression and decompression of the extremity in a pre-determined manner. The control means includes a sensing means for sensing the occurrence of a QRS complex in the patient's heart cycle, a computing means for computing an average time period between a selective number of successive sensed QRS complexes in successive heart cycles, which is capable of recomputing the average time period at each successive QRS complex and an adjustable timing means for initiating inflating and deflating the legging in a timing cycle, as described above in accordance with the methods of the present invention. The control means further includes an actuating means for triggering inflation of the enclosure at the beginning of the compression period and triggering deflation of the enclosure at the end of the compression period, thereby compressing and decompressing the extremity in response to the timing cycle.

BRIEF DESCRIPTION OF THE DRAWINGS

The foregoing summary, as well as the following description of preferred embodiments of the present invention, will be better understood when read in conjunction with the appended drawings in which:

FIG. 1 is a diagramatic representation of an intermittent compression apparatus having controls for performing the method of the present invention;

FIG. 2 is a typical EKG tracing of a normal heart rate;

FIG. 3 is a diagram relating certain circulation events in the heart to action of the intermittent compression apparatus, as controlled by the method of the present invention.

DETAILED DESCRIPTION OF THE INVENTION

Referring to the drawings and initially to FIG. 1, a system for promoting the circulation of blood through a patient's heart and extremity is illustrated. For this treatment, the circulation of blood is artifically enhanced by the compression and decompression of the extremity through the controlled application and removal of pressure on the extremity. For this purpose, an inflatable enclosure or air bag shown diagrammatically at 10 is provided for covering at least a portion of the patient's extremity to be treated. The inflatable enclosure is then inflated and deflated to apply controlled external pressure on the extremity.

Where one or both of a patient's leg are to be treated, for example, the inflatable enclosure, as diagrammatically illustrated in FIG. 1 is in the form of a one-piece inflatable legging having an enclosed boot 10. The legging should cover as much of the legs as possible in cases where promotion of blood flow through the leg and heart is warranted. For treatment of legs only (e.g., patients having atherosclerotic lesions), the legging should cover the distal atherosclerotic region as well as about 6 inches of healthy leg between the lesioned region and the heart.

The legging 10 is inflated and deflated with inflating fluid, preferably compressed air or other gas, which is introduced to and removed from the enclosure through a fluid access port 22, and exhaust outlet 24.

A fluid control system 20 functions to supply and exhaust compressed gas from a source 26 to and from the inflatable legging in order to compress and decompress the patient's leg to promote circulation of blood. The timing of compression and decompression of the leg by the fluid control system is controlled by a pulse monitor 13 so that compression and decompression of the patient's leg is phased to the patient's heartbeat. To accomplish this, the pulse monitor comprises a sensing device, such as an electrocardiograph (EKG) 14, for monitoring the patient's heartbeat, a computer 12 and a timer 16.

To precisely synchronize compression and decompression of the patient's leg to the patient's heartbeat, the sensor senses several successive QRS complexes in the patient's heart rate, and an average time period between successive QRS complexes is calculated by the computer. FIG. 3 illustrates at D a typical heart cycle of 0.65 seconds from an EKG display of a heart rate of 92 beats per minute. The average time period between QRS complexes is recalculated upon the occurrence of each next QRS complex, thereby allowing adjustment for irregularities in the heart rate. Based on the computed average time period, a timing cycle is initiated by the timer 16, at the occurrence of the next QRS complex. The timing cycle comprises an adjustable time delay and a compression period followed by a decompression period. The timing of the fluid control device is diagrammed at B in FIG. 3. As shown, an adjustable time delay 32 is provided to allow the pulse of blood to travel from the heart to the leg. During the time delay, the exhaust outlet 24 of the fluid control system remains operable to divert pressurized gas away from the inflatable legging.

At the conclusion of the time delay period 32, the exhaust outlet is closed and the fluid inlet 22 is activated to supply pressurized air or other fluid to the inflatable legging to pressurize the enclosure as indicated at 34. The inflatable enclosure remains pressurized for the duration of the compression period 34, when it is then triggered by the timer 16 to decompress as indicated at 36, at which time the fluid inlet 22 is closed and the exhaust outlet 24 is opened to deflate the inflatable legging. The time delay is adjusted such that the time delay 32 and the compression period 34 together do not exceed the average time period between QRS complexes, thereby avoiding compression of the leg during the next occurring QRS complex. This adjustment enables decompression of the extremity slightly before the projected occurrence of the next QRS complex, which, as described earlier, promotes circulation of blood through the heart, as well as through the extremity. In this manner, compression of the leg forces the flow of blood into the leg while not obstructing the natural blood pulses to the leg. To facilitate blood flow to the heart, the time delay 32 is adjusted so that the sum of the time delay 32 and the compression period 34 is about 0.02–0.1 seconds less than the average time period. As described in greater detail below, decompressing the leg for the period 36 in advance of the next QRS complex promotes emptying of the left ventricle, thereby decreasing the workload of the heart.

Referring to FIG. 2, a preferred embodiment of the present invention involves sensing the patient's heartbeats by electrocardiograph. FIG. 2 illustrates a typical EKG tracing, which can be utilized in the present invention to measure successive occurring QRS complexes, and to compute an average time period between said complexes. FIG. 2 illustrates the major deflection from the baseline in an EKG tracing, as described in greater detail below.

According to the present invention, a method is provided for promoting the circulation of blood through a patient's heart and selected extremity or extremities. The method involves precise timing of externally applied intermittent pressure, and release thereof, to a patient's extremity, in such a way as to reinforce the natural pulses of blood to the extremity, thereby facilitating circulation through the extremity and decreasing the work of the heart.

FIG. 3 at A displays the timing and pressure events in the heart cycle. The EKG tracing at D is labelled to indicate deflections from the baseline: "P" indicates atrial systole; "Q" (downward), "R" (upward) and "S" (downward), together comprise the "QRS" complex. The "T" represents ventricular repolarization or recovery. The QRS complex represents electrical systole for the ventricles. Mechanical systole, actual contraction of the heart muscle, occurs a few hundredths of a second later, as can be seen by the increase in pressure in the heart organ, displayed at A. Line 42 represents the pressure in the aorta, line 44 the pressure in the left ventricle, line 46 the pressure in the pulmonary artery, line 48 the pressure in the left atrium, line 50 the pressure in the right atrium and line 52 the pressure in the right ventricle. The aortic valve opens at 54 and closes at 56. The corresponding change in blood volume is diagramed at C in FIG. 3 in which line 60 represents the blood volume in the left ventricle and line 62 represents the blood volume in the right ventricle. Thus, the first fraction of mechanical systole between 0 and 54 is an isometric contraction in which the muscle tightens around the contained blood, raising the pressure within the left ventricle from a low level to the level of diastolic blood pressure. When the intraventricular pressure reaches diastolic blood pressure, the aortic valve opens and blood begins to leave the ventricle. As can be seen at C, the opening of the aortic valve is followed by a decrease in blood volume in the left ventricle.

Cardiac output may be increased by enhancing the emptying of the ventricle during systole. According to the method of the invention, this may be accomplished by timing the release of compression on the extremity such that the drop in pressure is perceived by the heart during the entire time of the systole. Because of the time needed for a change in pressure to move from the extremity to the heart, if the pressure in the extremity is not released until the next QRS complex, the drop in pressure is perceived by the heart only during approximately the last ⅔ of systole. In order for the drop in pressure to be perceived by the heart for the entire duration of systole, it is necessary to trigger decompression of the extremity late in diasrole, e.g. 0.02–0.1 seconds before the next occurring QRS complex. According to a preferred embodiment of the present invention, decompression of the extremity at 36 is triggered by the computer device 12, programmed to anticipate the occurrence of the QRS complex, and trigger deflation of the air bag approximately 0.04–0.1 seconds earlier than the QRS complex. According to the present invention, the occurrence of each QRS complex is projected by measuring the time between several successive previous QRS complexes, and computing an average time interval. Thereafter, the computer device adjusts the time delay 32 between the last QRS complex and inflation of the air bag, and adjusts the compression period 34 to trigger deflation of the bag approximately 0.04 seconds before the next projected QRS complex occurs.

Intermittent external compression therapy is designed to help the general circulation, but especially the arterial circulation in extremities, e.g., legs. For example, to aid in circulation to legs, compression on the leg should be released with the QRS complex so that the wave form generated by the heart may enter the legs unobstructed. Because the early part of the wave form reaches about 0.15 seconds after the QRS complex, unobstructed flow is accomplished whether the legs are decompressed with the QRS complex or shortly seconds before the complex. The extremity should never be released after the QRS complex. Thus, the timing of the delay 32 and the compression 34 of the legs, are preferably adjusted to maximize both cardiac output and circulation to the extremity by timing the release of pressure on the extremity to approximately 0.02–0.1 seconds before the next QRS complex. In any event, the decompression period 36 should be in the range of 0 to 0.2 seconds before the next timing cycle, to enable decompression to occur in the last ⅓ of the heart cycle.

The method of the invention may be used in connection with intermittent external compression devices, such as those disclosed in U.S. Pat. Nos. 3,961,625, 4,269,175, 4,343,302 and 4,590,925, all to the present inventor. Those devices utilize air-inflatable leggings with fully enclosed boots (referred to herein interchangeably as "enclosure," "air bag," "legging" or "boot"), which are preferable for use with the method of the present invention. A one-piece booted legging, particularly one that encloses the entire leg, is more effective than cardiac assist devices using several leg balloons with open areas of legs between the balloons, inasmuch as the open areas are capable of blunting the force of balloon compression as the exposed tissues expand with blood.

The method of the invention is preferably implemented through the use of a pulse monitor having a computer device. The monitor senses the QRS complex in the patient's heart cycle. The computer measures the time interval between a selected number of successive QRS complexes (e.g., 2–13), then computes an average time interval based on the measurement of the successive QRS complexes.

Any change in heart rate will necessitate a change in the monitor settings if the compression of the extremity is to precede and end with (or shortly before) each QRS complex. The average time period between QRS complexes is divided into a pre-determined time delay 32 and a compression period 34, the sum of which should be equal to the average time period (or the average time period minus 0.02–0.1 seconds, in the preferred embodiment leaving a terminal decompression period 36), or the average time period to which a correction factor is applied, as described in a preferred embodiment below. In using the method of the invention with any of the compression devices disclosed in the patents enumerated above, the compression period must be set for a long enough time to achieve good compression within the device enclosing the extremity. The larger the air bag (or the larger the patient), the longer the time needed for the air bag to inflate to the desired pressure. This compression period should preferably range from between about 0.34 to about 0.5 seconds, and should be adjusted and set in consideration of the size of the air bag and of the extremity to be enclosed.

Once the compression period is set, the time delay between the QRS complex and when inflation of the boot is initiated must be adjustable so that the sum of the time delay 32 and the compression period 34 is equal to the average time period described above. In practice of the present invention, the time delay is automatically adjusted, depending on the average time period calculated for the prior successive QRS complexes. As a simple example, suppose a series of three successive heartbeats occur such that the intervals between the successive QRS complexes are: 0.9 seconds, 1.1 seconds and 1.0 seconds. The average time period calculated by the computer would then be 1.0 seconds for the next immediate timing cycle. Suppose, in addition, that the extremity to be treated is the lower portion of a patient's leg, and that the size of the air bag is relatively small, thereby indicating a compression period of approximately 0.34 seconds. Thus, the time delay 32 between the QRS complex and the initiation of inflation of the air bag will automatically be adjusted to equal 0.66 seconds, which is the difference between the average time period (1.0 seconds) and the compression period 34 (0.34 seconds).

The next timing cycle follows the same format, except that it calculates the average time period from the three most recent previous QRS complexes. Extending the above example, if the time interval for the next QRS complex is again 1.0 seconds, then the computer would average 1.1 seconds, 1.0 seconds and 1.0 seconds, arriving at a new average time period of 1.033 seconds.

It has been discovered in accordance with the present invention that the accuracy of predicting a next occurring QRS complex improved by increasing the number of successive QRS complexes used to calculate the average time period. For instance, a timing cycle that is equal to an average time period calculated from 10 preceding QRS complexes tends to more accurately predict the occurrence of the next QRS complex, than would a timing cycle equal to an average time period calculated from two or three successive QRS complexes. This predictive accuracy is further enhanced by comparing the time interval between the last pair of successively sensed QRS complexes (i.e., the time interval of the last heartbeat) with the average time period, and applying a correction factor, dependent on the deviation of the last heartbeat from the average time period, to predict the occurrence of the QRS complex constituting the next heartbeat. If the time period of the last heartbeat is shorter than the average time period by a pre-determined threshold amount, a correction factor is applied that predicts a longer time until the next occurring QRS complex. Similarly, if the time interval of the last heartbeat is longer than the average time period by a predetermined threshold amount, a correction factor is applied that shortens the time interval predicted for the next occurrence of a QRS complex. If the time interval of the last heartbeat is within a predetermined range of the average time period, then no correction factor would be applied and the predicted occurrence of the next QRS complex would be an interval approximating the average time period. Methods and formulas utilizing such correction factors as described in greater detail in Example 1.

Because the method of the invention calls for adjusting the pre-determined time delay on the basis of immediately previous QRS complexes, the timing cycles are much more precisely aligned to the patient's actual heart rate than if the pre-determined time delay were not adjustable. Moreover, automatic adjustment of the pre-determined time delay by a computer is greatly preferable to a system involving manual adjustment of the time delay, which requires constant attention by a technician and is subject to human error. The compression period is selected to promote optimum pumping of blood through the extremity and heart, and depends upon the size of the extremity. Once selected, the compression period may remain fixed, while the delay time is adjustable, as described above.

In a particularly preferred embodiment, a legging or boot, as described in U.S. Pat. Nos. 3,961,625, 4,269,175, 4,343,302 and 4,590,925 (to the present inventor) is used in conjunction with a pulse monitor programmed to follow and accurately anticipate the next occurring QRS complex of a patient, according to the following protocol, which utilizes a system of correction factors as described above:

1. An average time period is calculated using the 10 next preceding heartbeats (a heartbeat or beat refers to the time interval between two consecutive QRS complexes).

2. The last beat is compared to the average of the preceding 10 beats and a correction is made in the estimation of the next occurring beat if the last beat differs by more than 10% of the average.

a) If the last beat is less than 90% of the average, the next beat is estimated to be 10% above the average, according to the following formula:

$$\text{If } TL < \mathbf{0.9}\% \times TA, \text{ then } TN = \mathbf{1.1} \times TA$$

where TL is the time between QRS complexes for the last beat, TA is the average time period of the last 10 beats and TN is the estimated time period between the last QRS complex and the next QRS complex.

b) If the last beat is 10% above the average for the previous 10 beats, the next beat is estimated to be 12% below the average, according to the following formula:

$$\text{If } TL > \mathbf{1.1} \times TA, \text{ then } TN = \mathbf{0.88} \times TA$$

c) If the last beat is within 10% of the average of the previous 10 beats, the next beat is estimated to equal the average, according to the following formula:

$$\text{If } TL \geqq \mathbf{0.9} \times TA, \text{ and } TL \leqq \mathbf{1.1} \times TA,$$

then TN= TA

With the availability of an estimate of the timing cycle for the next beat, a new time delay is estimated for each beat such that the time delay is equal to the timing cycle minus the compression period, which is the sole constant set on the pulse monitor at the initial programming for each patient, and is determined by the size of the inflatable legging or boot and the legs of the patient. For example, the compression period may be set at 0.40 seconds for a small boot, 0.42 seconds for a medium boot, and 0.42–0.44 for a large boot, the aforementioned boot being "full" boots, having leggings reaching over the knee or higher (to the groin in a preferred embodiment for facilitating cardiac function). If a short boot, referred to herein as a "miniboot," is used, the compression period is shorter, usually being set at 0.34 seconds. The pulse monitor thus requires only an initial input for the compression period. It subsequently adjusts the delay time automatically to maintain end-diastolic pumping in spite of changes in heart rate or rhythm.

The preferred embodiment of timing the release of compression on the extremity shortly before the occurrence of the next QRS complex is particularly advantageous when combined with the aforementioned inflatable legging or boot device. In this regard, the optimal timing of release of the leg before the next QRS complex to maximize the reduction of afterload in early systole is likely to vary slightly from patient to patient because of differences in vessel elasticity, blood pressure and atherosclerotic lesions. Thus, the timing cycle for the preferred embodiment of the method of the invention in conjunction with the aforementioned legging or boot is summarized by the following formula:

$$Th = Td + Tc + Tr + Tg$$

where Th is the time period between the last and next-occurring QRS complex (i.e., one heartbeat), Td is the time delay, Tc is the compression period, Tr is the time of release before the next QRS complex (to allow for pulse travel time such that the drop in pressure is received by the heart during the entire systole) and Tg represents any residual gap time resulting from error in estimating the occurrence of the next QRS complex (thus Tg+Tr together comprises the terminal decompression period). Tg is minimized by the ability of the monitor to follow the average Th and to anticipate the occurrence of the next QRS complex. The compression period (Tc) must be set to minimum values necessary for the boot to develop effective pressure to move blood. The time delay (Td) also must be kept above minimum values, which should not be further shortened if the boot is not to inflate during cardiac systole or before the pulse wave has reached the leg. At rapid heart rates (90–120 beats per minute) having low Th values (0.50–0.67 seconds) allowance for a terminal decompression period (Tr) is not practical; hence the boot compression is released with detection of the next QRS complex. Similarly, intermittent compression therapy using the "miniboot" described above does not have appreciable cardiac assisting effect, so allowance for Tr is again not practical. Therefore, the monitor may be set to assume that a "miniboot" is in use when the compression period (Tc) is set to short time periods, such as 0.34 seconds. In this case, the compression of the boot is also released with the detection of the next QRS complex.

When heart rates are less than 90–100 beats per minute and when a full length inflatable legging is used, the preferred embodiment may be employed to advantage and the monitor may be set to release compression shortly before the occurrence of the next QRS complex. Empirical EKG studies of boot efficiency indicate that a terminal decompression period of 0.04 seconds provides the best boot efficiency, on the average. Thus, in a preferred embodiment, the monitor is programmed to anticipate the next occurring QRS complex, and to release compression of the boot 0.04 seconds prior to the next anticipated QRS complex. With the compression period and the terminal delay period set as constant, the monitor compensates for changes in heart rate by adjusting the time delay for each next occurring QRS complex as follows:

1. The average time between each of the last 10 QRS complexes is continually calculated and the timing cycle for the next occurring QRS complex is calculated as described above.

2. An adjustment for a terminal decompression period is programmed in in cases of full length boot treatments, or if the pulse rate is under 90 beats per minute (Th=0.67 seconds or longer) as follows (where TN is the anticipated length of the next timing cycle):

a) If $TN<0.67$, $Tr=0$ and $Td=TN-Tc$ b) If $TN>0.67$ seconds, $Tr=0.04$ and $Td=Tn-Tc-0.04$ c) If $Tc \leqq 0.34$ seconds, $Tr=0$ and $Td=TN-Tc$ Thus, the preferred embodiment of monitor use with an inflatable legging or boot continually anticipates the next occurring QRS complex by employing an adjustable delay time (Td) to place decompressions in the end of diastole to maximally reduce cardiac afterload in early systole when it can effectively be accomplished (e.g., during therapy with full-sized boots on patients having heart rates less than 90 beats per minute).

The method described and exemplified above is particularly advantageous for two reasons. First, patients having various heart diseases and conditions often have irregular heart rates. The method of the invention decreases the problematic effects of an irregular heart rate and enables such patients to benefit from intermittent external compression therapy. Second, the beneficial effects of intermittent compression therapy on cardiac output often reflexively slows the heart rate. The method of the invention is capable of taking the slowing into account.

Intermittent external compression therapy is difficult in patients whose pulse rates are faster than 120 beats per minute, since there is only 0.5 seconds or less between QRS complexes. To obtain adequate pressure on the extremity requires approximately 0.34–0.50 seconds, leaving 0–0.16 seconds for a time delay, which may be insufficient to avoid interference with the natural blood pulses to the extremity. The compression period is set to allow for adequate pressurization in the air bag so a short delay time must chosen so that the sum of the delay time and the compression period equals the time between QRS complexes. Another complicating factor, however, is that the amount of time needed to prime the legs with blood prior to compression increases with the severity of peripheral arteriosclerosis and accompanying obstructive arterial lesions.

According to another aspect of the present invention, the above-mentioned complications may be substantially reduced or eliminated by setting the monitor to empty the heart on every second or third QRS complex instead of emptying the heart on every QRS complex. For example, for a pulse rate of 140, the monitor may be set to facilitate ventricular emptying every other heartbeat, resulting in maximizing systolic emptying of the heart 70 times a minute. To accomplish this, the compression period is set to provide adequate pressurization of the air bag, and the time delay is adjusted so that the timing cycle encompasses two QRS cycles, rather than one. In the case of very rapid heart rates, the time delay may be adjusted to allow for three successive QRS complexes. Thus, compression of the extremity may be adjusted to occur after every heartbeat, every second heartbeat or every third heartbeat. In a preferred embodiment, the computer in the monitor may shift from 1:1 to 2:1 or 3:1 automatically, depending on the heart rate of the patient.

In this embodiment, the time delay 32 is adjusted so that the sum of the time delay 32 and the compression period 34 is an integral multiple of the average time period between complexes, which enables compression of the extremity to occur less often than with every QRS complex, while still avoiding inflation of the air bag during occurrence of a QRS complex. Patients having rapid heart rates may thereby benefit from the method of the invention, even though their heart rate is too rapid to allow a suitable time delay and compression period to occur with each QRS complex.

This aspect of the present invention is also used to accommodate the additional amount of time needed to prime legs of patients having peripheral arteriosclerosis and accompanying obstructive arterial lesions. In patients with severe disease, the monitor may be set to allow two or three pulse waves to enter the legs before compressing the legs. The need for these adjustments increases with increasing heart rates. Thus, patients with severe arteriosclerosis and heart rates over 100 beats per minute might be treated with a 3:1 ratio (i.e., 3 pulses allowed to enter the leg before each boot compression). Patients with less severe disease might be treated with a 2:1 ratio.

Patients with atrial fibrillation have irregular heart rates that may also be lessened by combining two or more timing cycles prior to compression, according to this aspect of the invention. Combining two or three irregular heartbeats before a single compression enable the pulse monitor to compress the leg with a more regular rhythm than if the monitor was set to compress after each QRS complex.

In another embodiment, the pulse monitor is controlled by an internal clock pacer, that can be set to approximate the average heart rate of the patient, but which operates independent of the patient's heartbeat. This mode of operation is useful for patients whose condition leaves them with no reliably detectable pulse waves from which to cue initiation of a timing cycle (e.g., patients with a completely blocked aorta). An additional setting on the monitor enables the monitor to combine two or three approximated heartbeats prior to initiating compression of the inflatable enclosure. This feature is sometimes referred to herein as a "divide by" switch. For example, on monitors having a pacer that is set from 30 to 120 beats per minute, when the "divide by" switch is set at 2:1, the range becomes 15–60 beats per minute. Likewise, if the "divide by" switch is set to 3:1, the range becomes 10–40 beats per minute. These slow settings are useful in treating patients with high arterial occlusions (i.e., thrombosed iliac artery or common femoral artery). In these situations, blood is allowed to slowly flow into the leg through collateral blood vessels and the inflatable legging is used to disseminate the blood throughout the leg. Such patients are best treated with the bed tilted to allow gravity to assist the leg in priming the leg before compression of the inflatable legging.

Thus, the method of the invention is preferably embodied in a pulse monitor, which controls a fluid control system. The fluid control system functions to supply and exhaust compressed gas (e.g., air) to and from the inflatable enclosures, thereby to compress and decompress the patient's extremities. Such a pulse monitor may be used on any fluid control system, but it is preferable to use the system disclosed and claimed in my prior U.S. Pat. No. 4,590,925 issued on May 27, 1986. The system uses a pulse monitor to control the fluid control system so that compression and decompression of the patient's extremity is synchronized to the patient's heartbeat (except when the patient has no detectable QRS complex, in which case an internal pacer is used, as described above). As shown in FIG. 3, during the time delay 32, an exhaust outlet 24 of the fluid control system remains open to vent pressurized gas from the inflatable air bag 10. At the conclusion of the time delay, the exhaust outlet is closed and an air inlet is opened to supply pressurized air to the inflatable bag for the compression period 34. The bag remains pressurized until triggered to initiate the decompression period 36, according to the timing described above. To ensure that the patient's extremity is not subjected to extreme pressure and that the air bag is not inflated during a QRS complex, several safety features are incorporated into the adjustable pulse monitor. For example, the monitor may be set so that an early QRS complex automatically interrupts compression of the air bag and signals deflation, thus prohibiting inflation of the air bag during cardiac systole. Likewise, the monitor may be set with a mechanism to interrupt inflation of the air bag, should a designated peak pressure be exceeded. In a preferred embodiment, the monitor and fluid control system are adjusted so that inflation of the air bag will not be allowed if the pressure within the air bag does not return to a pre-set baseline level, or a selected value near baseline.

The method of the invention is preferably embodied in a pulse monitor attached to a visual display screen. Information related to the control and operation of the intermittent pressure therapy may be displayed on the screen. Such information may include: (1) the EKG tracing showing the occurrence and shape of the QRS complex; (2) the duration of each adjustable time delay; (3) the duration of the compression period; (4) the pressure of the air bag being applied to the patient's extremity; (5) brachial systolic and diastolic blood pressure; (6) changes in the blood flow in the skin of the extremity being compressed, which can be measured by a photoelectric plethysmographic (PPG) sensor and/or transcutaneous $pO_2$ electrode; and (7) changes in the blood flow to a noncompressed part (e.g., finger, arm or earlobe) to reflect systemic blood flow, also measurable by PPG, pulse volume apparatus and/or transcutaneous $pO_2$ electrode.

In a preferred embodiment of pulse monitor display, the delay period and compression period are shown along with the EKG display so that the actual timing is seen by the operator. This system has the advantage that anomolous waves (e.g., unusually intense "T" waves, which follow the QRS complex in the heart cycle) are not chosen to cue initiation of the timing cycle. Additionally, a pulse volume display is employed, which is useful to show a pulsatile function separate from the EKG that also documents cardiac systole. This pulse wave sensor may be placed on the ear, finger or some element of the limb. It should display a pulse rate identical to that of the EKG and should follow closely after the QRS complex of the EKG. As a safety feature, detected QRS signals that are not followed by a pulse wave, as detected by the secondary pulse display, are considered static and do not signal initiation of the timing cycle. The pulse wave may also be used in demonstrating optimal settings for release of compression prior to the occurrence of a next QRS complex, if a setting other than 0.04 seconds is determined to be desirable. As described above, photoelectric plethysmographic sensors may substitute in this embodiment for the pulse volume sensor. The use of the pulse sensor in this fashion comprises another unique safety feature of a pulse monitor utilized in the present invention.

The methods and devices of the present invention offer several advantages over methods presently available for promoting the flow of blood through an extremity. Most notably, the timing of compression and decompression of the extremity can be closely correlated with the natural flow of blood accompanying each heartbeat. This is accomplished by tying the inflation and deflation of the air bag with the occurrence of a QRS complex, said complex signaling the electrical systole of the heart cycle. By adjustably timing the deflation of the air bag to occur with, or slightly before, the next QRS complex, the blood pulse is able to enter the extremity freely, without being blocked by outflow of the previous pulse. This enables optimum promotion of blood flow with the application of relatively low pressure (e.g., 55–70 mm mercury to the extremity). Because the time delay is adjusted automatically, on the basis of a selected number of previous successive QRS time intervals, even patients with irregular or rapid heart rates can be treated by this method. Moreover, adjusting the timing cycle so that compression to the extremity is released 0.02–0.1 seconds prior to the occurrence of the next QRS complex introduces the additional advantage of promoting optimum circulation of blood, not only through the extremity, but through the heart as well. The precise timing required to effect such optimal blood flow was heretofore unavailable, as current methods rely on non-adjustable or manually-adjustable timing cycles. Thus, the methods of the present invention represent a significant advance over methods previously employed.

Preferred embodiments of the present invention offer the following additional advantages:

(1) superior anticipation of the occurrence of the next QRS complex using an average of time periods between the last 10 QRS complex and corrections of +10% if the time period of the last beat is 10% below the average time period and −12% if the time of the last beat is 10% above the average time period;

(2) a terminal decompression period of 0.04 seconds prior to the anticipated next occurring QRS complex, to optimally unload early systole in patients with heart rates under 90–100 beats per minute;

(3) an internal pacer that approximates a patient's heart rate, for use with patients not having detectable pulse waves to cue initiation of the timing cycle;

(4) a "divide by" switch allowing the inflatable enclosure to compress every other or every third heartbeat at heart rates over 90–100 beats per minute or for patients having irregular heartbeats, or allowing the heart to prime the legs with two or three beats before leg compression, for treatment of patients having significant peripheral arteriosclerotic occlusions;

(5) an inflatable legging having a fully enclosed boot, the legging being of different sizes to allow any desired portions of legs to be treated;

(6) a single full leg bag from toes to the high groin for both use in assisting heart function and in treating legs with diffuse arteriosclerotic lesions throughout the length of the leg, this inflatable enclosure having advantages over other cardiac-assist devices, which use several leg balloons with open areas of leg between the bags, the open areas capable of blunting force of balloon compressions as the tissue expands with blood; and (7) a dual sensing of heart function: an EKG, which senses the QRS complex, and a pulse volume sensor, which senses a pulse wave. The pulse wave sensor acts as a guide as to the validity of the detected QRS signal; QRS complexes not soon followed by a pulse wave being determined to be invalid signals.

The following example is provided to describe the invention in further detail. This example is intended to illustrate and not to limit the invention.

EXAMPLE 1

In this example, several calculation methods were compared to determine the optimum method for anticipating a next occurring QRS complex in patients having atrial fibrillation. Atrial fibrillation represents one of the most irregular heart rates. A reliable method for anticipating a next occurring QRS complex in such an irregular heart rate should be effective for use with the full range of heart rates exhibited by different patients.

Heart rates of patients having atrial fibrillations were measured by EKG. Two- to three-minute EKG strips from these patients were obtained, and the intervals between QRS complexes were measured. These numbers, varying from 58 to 249 per strip, were provided in data statements to computer programs, which applied different formulas and calculations for predicting the next occurring QRS complex, as described below. The following criteria were employed for determining an effective application of the method of the invention (i.e., an "effectively-timed beat"):

(a) Acceptably predicted beats were designated "X" beats and defined as instances in which a boot compression would have been either not interrupted at all by an early-occurring QRS complex, or interrupted by no more than 0.04 seconds. Thus, an "X" beat was tallied if, $$T1 > T(calc) - 4$$

where T1 is the actual time interval between QRS complexes in hundredths of a second between the last beat and the next beat, and T(calc) is the calculated predictive time period for the same interval. In the calculations, "X" is given as a percentage of all beats on the EKG strip. A high percentage of "X" beats was considered desirable.

(b) Unacceptably predicted beats were designated "Y" beats, and defined as those in which boot compression would be interrupted by premature QRS complexes occurring more than 0.04 seconds before the end of the calculated time period before the next occurring QRS complex. These were considered undesirable weak compressions, making a low "Y" value desirable. Thus, a "Y" beat was tallied if $$T1 < T(calc) - 4.$$

(c) "Z" beats were designated as those in which boot compression would have occurred within 0.04 seconds of the end of the calculated time period between the last QRS complex and the next occurring QRS complex. In theory, these are the most desirable beats, but because they occur less frequently than "X" beats, and because good boot compression is achieved with "X" beats, more emphasis was placed on having a good percentage of "X" beats than "Z" beats. A "Z" beat was tallied if T1=T(calc)±4.

Calculations

Twenty different calculation methods were evaluated for their ability to generate a high percentage of "X" beats. These are set forth below, with the following definitions:

Th=generally, the time interval between two successive QRS complex

TF=the next occurring Th predicted by the formula or method being tested

Tr=release time (i.e., pulse travel time allowance) (0.04 sec in this preferred embodiment)

1: (% acceptable "X" beats when the next beat (TF) is estimated to be equal to the immediate last beat);

2: (% acceptable "X" beats when the next beat is estimated to be the average of the immediate last two beats);

M2: (% acceptable "X" beats when formula "M" is applied both to the duration of the last beat (T2) and the average of the last two beats (TA) . . .

Formula "M": $TF=(1-9\mathrm{Log}(T2/TA)/3.14))\times TA''Tr$;

N2: (% acceptable "X" beats when formula "N" is applied both to the duration of the last beat (T2) and the average of the last two beats (TA) . . .

Formula "N": If $T2 \geqq 90\%TA$ and $T2 \leqq 110\%TA$, $TF=TA-Tr$ If $T2<90\%TA$, $TF=110\%TA-Tr$; If $T2>110\%TA$, $TF=88\%TA-Tr$;

O2: (% acceptable "X" beats when formula "O" is applied both to the duration of the last beat (T2) and the average of the last two beats (TA) . . .

Formula "O": If $T2 \geqq 90\%TA$ and $T2 \leqq 110\%TA$, $TF=TA-Tr$ If $T2<90\%TA$, $TF=105\%TA-Tr$ If $T2>110\%TA$, $TF=92\%TA-Tr$ P2: (% acceptable "X" beats when method "P" is applied both to the duration of the last beat (T2) and the average of the last two beats (TA) . . .

Method "P": Where T1 is the duration of next beat, T2 the duration of the last beat, T3 the duration of the beat preceding T2 and TA, the average duration of a designated number of beats (for method P2, the average of T2+T3; for method P10 (set forth below), the average of T2+T3+T4+. . . +T11; and for method P12 (set forth below), the average of T2+T3+. . . +T13), five pools for the value T2/TA are calculated: #1 T2/TA<85%TA, #2 T2/TA≧85%TA and <95%TA, #3 T2/TA≧95%TA and ≦105%TA, #4 T2/TA≧105% and TA≦115%TA, and #5 T2/TA>115%TA. For each pool, the average correction for the next beat (T1/TA) is continually calculated for the entire EKG strip. This correction is applied to the last beat to predict the next beat. This method should become more predictably accurate as the program runs and the average in each pool is dependent on more values. To account for this potential improvement, the "P" method was run on three separate submethods. In method P2, TA averaged T2+T3 and the pools were calculated consecutively through the strip; in method P12 below, TA averaged T2–T13 and the pools were calculated consecutively through the strip; in method P all (below), TA (the average duration of beats) was first calculated for the entire strip and this average was held constant for the calculations of the pools and their correction factors; and for method P12cal, the average correction factor for each pool was initially calculated along with PA for the entire strip and then the program run. In the latter situation, it was thought that the best operation of the method would be approximated matching the uncommon clinical situation where a patient lies motionless undisturbed over hours.

3: (% acceptable "X" beats when the next beat is estimated to be the average of the immediate last three beats);

5: (% acceptable "X" beats when the next beat is estimated to be the average of the immediate last five beats);

10: (% acceptable "X" beats when the next beat is estimated to be the average of the immediate last ten beats);

M10: (% acceptable "X" beats when formula "M" above is applied and TA is the average of the last ten beats);

N10: or "N" (% acceptable "X" beats when formula "N" above is applied and TA is the average of the last ten beats);

O10: (% acceptable "X" beats when formula "O" above is applied and TA is the average of the last ten beats);

P12: (% acceptable "X" beats when method "P" is applied and TA is the average of the last 12 beats);

all: (% acceptable "X" beats when the average for all of the beats on an EKG strip was first precalculated and the next beat repeatedly compared to this predetermined average);

M all: (% acceptable "X" beats when Formula "M" above applied and TA is the precalculated average of all of the beats);

N all: (% acceptable "X" beats when Formula "N" above applied and TA is the precalculated average of all of the beats);

O all: (% acceptable "X" beats when Formula "O" above applied and TA is the precalculated average of all of the beats);

P all: (% acceptable "X" beats when method "P" applied and TA is the precalculated average of all of the beats);

P12 cal: (% acceptable "X" beats when the pools are previously determined as described above for P2);

P2 cal: (% acceptable "X" beats when pools are previously calculated on basis of TA equal to the last two beats and the program run with TA equal to the last two beats)

The results of these calculations are shown below in Table 1 with "X," "Y" and "Z" beats shown as a percentage of the total number of beats on each EKG strip.

TABLE 1

| Method | % "X" beats | % "Y" beats | % "Z" beats |
|---|---|---|---|
| All | 66.12 ± 9.05 | 33.83 ± 9.06 | 19.94 ± 8.80 |
| M all | 65.75 ± 7.38 | 34.20 ± 7.37 | 18.81 ± 6.53 |
| N all | 72.48 ± 8.04 | 27.47 ± 8.03 | 19.47 ± 8.95 |
| O all | 63.17 ± 7.02 | 36.94 ± 7.26 | 18.30 ± 6.07 |
| P all | 67.93 ± 9.38 | 32.02 ± 9.39 | 19.15 ± 7.45 |
| 1 | 64.39 ± 5.12 | 33.49 ± 5.7 | 15.35 ± 4.64 |
| 2 | 65.12 ± 5.77 | 33.68 ± 5.71 | 16.73 ± 6.07 |
| 3 | 65.30 ± 5.90 | 33.98 ± 6.13 | 18.09 ± 5.43 |
| 5 | 65.85 ± 7.37 | 33.47 ± 7.77 | 18.65 ± 7.73 |
| 10 | 66.00 ± 8.00 | 33.65 ± 8.28 | 19.45 ± 8.38 |
| M2 | 65.10 ± 6.10 | 34.83 ± 6.19 | 17.46 ± 7.13 |
| M10 | 65.22 ± 7.10 | 34.78 ± 7.10 | 18.20 ± 6.88 |
| N2 | 69.55 ± 5.80 | 29.48 ± 5.63 | 16.99 ± 6.25 |
| N10 | 71.70 ± 7.68 | 28.08 ± 7.86 | 19.13 ± 7.39 |
| O2 | 61.80 ± 4.30 | 37.21 ± 4.17 | 18.44 ± 6.53 |
| O10 | 64.00 ± 7.36 | 35.79 ± 7.45 | 18.76 ± 6.37 |
| P2 | 64.36 ± 8.00 | 37.54 ± 9.56 | 18.27 ± 7.35 |
| P12 | 67.42 ± 9.37 | 37.54 ± 9.56 | 18.58 ± 7.38 |
| P2 cal | 62.46 ± 9.56 | 32.58 ± 9.37 | 18.19 ± 7.30 |
| P12 cal | 67.25 ± 10.89 | 32.75 ± 10.96 | 19.58 ± 8.60 |

"X" and "Y" Data:

Formula "N" produced the best result for 30 tracings of atrial fibrillation: 72.48±8.04% using an average Th of the entire EKG tracing and 71.70±7.668% using an average Th of the 10 previous beats. Formula "N" also produced the lowest "Y" values for the 30 atrial fibrillation EKG tracing.

Table 2 displays the mean percent "X" beats results and standard deviations for each method, ranked in order of best to worst predictive accuracy.

TABLE 2

| Method | Mean ± Std | Probability (Paired comparisons and Student's t-test |
|---|---|---|
| N all | 72.48 ± 8.04 | NS |
| N 10 | 71.70 ± 7.68 | — |
| N2 | 69.55 ± 5.8 | <0.1 |
| P all | 67.93 ± 9.38 | <0.01 |
| P 12 | 67.42 ± 9.37 | <0.001 |
| P12cal | 67.25 ± 10.89 | <0.01 |
| All | 66.12 ± 9.05 | <0.001 |
| 10 | 66.00 ± 8.00 | <0.001 |
| 5 | 65.85 ± 7.37 | <0.001 |
| M all | 65.75 ± 7.38 | <0.001 |
| 3 | 65.30 ± 5.9 | <0.001 |
| M 10 | 65.22 ± 7.10 | <0.001 |
| 2 | 65.12 ± 5.77 | <0.001 |
| M2 | 65.10 ± 6.1 | <0.001 |
| 1 | 64.39 ± 5.12 | <0.001 |
| P2 | 64.36 ± 8.0 | <0.001 |
| O 10 | 64.00 ± 7.36 | <0.001 |
| O all | 63.17 ± 7.02 | <0.001 |
| P2cal | 62.46 ± 9.56 | <0.001 |
| O2 | 61.80 ± 4.30 | <0.001 |

As can be seen from Table 2, method "N all" (Formula N utilizing an average Th of the entire EKG tracing), yielded the highest percent of "X" beats. However, since this method is not possible to employ in an actual situation where an EKG tracing has not yet been generated, Method "N10" (Formula N utilizing an average Th of the 10 preceding beats) provided comparable results, not significantly different from Method "N all". Table 2 also displays the probability of statistically significant differences comparing Method "N10" with the remaining methods evaluated, using paired comparisons and the Student's t-test. As can be seen, Method "N10" was significantly better than the other methods, usually at a probability level of 0.001. Another trend revealed by the results set forth in Table 1 and Table 2 is that there is a progressive improvement in prediction with an increasing number of beats averaged (i.e., an average of all beats tended to give better results than an average of 10 beats, a 10 beat average was better than a 5 beat average, a 5 beat average was better than a 3 beat average, a 3 beat average was better than a 2 beat average, and a 2 beat average was better than a 1 beat average). In this regard, it is of interest to note that Formula N, when calculated from only a 10 beat average, gave significantly better results than methods employing a simple average of 58–249 i.e., all beats).

"Z" Data:

For "Z" beats, none of the formulas M, N, O or P improved on the usage of average Th as calculated for a whole EKG strip. As mentioned before, averaging an entire EKG strip is not possible in practice, but served as a theoretical standard by which to compare the formulas tested. In that capacity, formula "N" was comparable to, or slightly better than the other formulas tested in approaching the value reached for Z beats when the average Th for the entire EKG was used.

Although all the formulas used offered a reasonable degree of accuracy in predicting the occurrence of the next QRS complex, method "N10" appears to be the most desirable method because of its simplicity and superior results based on the "acceptable beats" criterion. Utilizing Formula N, the pulse monitor may be programmed as follows:

1. The intervals between QRS complexes (Th) in the last 10 beats are continually averaged;

2. The last beat is compared to the average of the preceding 10 beats and a correction is made in the estimation of the next beat if the last beat differs by more than 10% of the average:

(a) If the last beat is less than 90% of the average, the next beat is estimated to be 10% above the average (i.e., 1.1 times the average);

(b) If the last beat is 10% above the average, the next beat is estimated to be 12% below the average (i.e., 0.88 times the average);

(c) If the last beat is within 10% of the average, the next beat is estimated to equal the average.

While certain preferred embodiments of the present invention have been illustrated and described, the present invention is not limited to these embodiments. For example, the methods of the present invention may be applied to external intermittent compression devices which do not comprise an inflatable air bag. For example, pressurization by means of other fluids, such as water, have been disclosed. The methods of the invention may be utilized in connection with such devices. Other modifications may be apparent to one skilled in the art within the scope of the following claims.

What is claimed is:

1. A method for promoting circulation of blood through a patient's heart and extremity comprising the steps of:

a) applying an inflatable enclosure to the extremity, so that upon inflation and deflation of the enclosure, the extremity is alternately compressed and decompressed;

b) sensing a QRS complex in a heart cycle of the patient and computing an average time period between a selected number of successive sensed QRS complexes;

c) initiating a timing cycle for compressing and decompressing said extremity, said timing cycle being comprised of an adjustable time delay, a compression period and a decompression period, said timing cycle being calculated relative to said average time period, said timing cycle being initiated at a QRS complex next following said selected number of successive sensed QRS complexes, said timing cycle being re-calculated at each succeeding QRS complex;

d) inflating the inflatable enclosure at the end of said time delay following the initiation of said timing cycle, thereby effecting compression of the extremity at the conclusion of the time delay;

e) maintaining said inflation of the inflatable enclosure over said compression period and venting the inflatable enclosure to initiate said deflation after said compression period; and f) controlling said timing cycle relative to said average time period so as to initiate said decompression period sufficiently late in said heart cycle to facilitate both entry of a QRS-associated pulse wave into said extremity and ventricular ejection of blood from said heart, but before said next occurring QRS complex, thereby promoting circulation of blood through said heart and said extremity of the patient, said controlling of said timing cycle comprising the steps of:

i) comparing a final time period between a last-occurring pair of successive QRS complexes in said average time period with said average time period to determine if said final time period differs in duration from said average time period by either of at least a first predetermined amount shorter than said average time period or a second pre-determined amount longer than said average time period;

ii) adjusting said timing cycle to be a first selected amount longer than said average time period when said final time period is at least said first predetermined amount shorter than said average time period;

iii) adjusting said timing cycle to be a second selected amount shorter than said average time period when said final time period is at least said second predetermined amount longer than said average time period; and iv) adjusting said timing cycle to be approximately equal to said average time period when said final time period differs from said average time period by less than said first pre-determined amount shorter and said second pre-determined amount longer than said average time period.

2. A method according to claim 1, wherein, in said controlling steps, said first pre-determined amount shorter is 10% shorter than said average time period, said first selected amount longer is 10% longer than said average time period, said second predetermined amount longer is 10% longer than said average time period and said second selected amount shorter is 12% shorter than said average time period.

3. A method according to claim 1, wherein said decompression period is initiated during a last third of said timing cycle.

4. A method according to claim 1, wherein said decompression period is 0.1 seconds or less.

5. A method according to claim 4, wherein said decompression period is initiated 0.04 seconds prior to initiation of a next timing cycle.

6. A method according to claim 1, wherein said time delay is adjusted so that said timing cycle is calculated relative to an integral multiple of said average time period, thereby enabling compression of said extremity to occur with less frequency than with every QRS complex, while avoiding inflation of said inflatable enclosure during occurrence of a QRS complex.

7. A method according to claim 1, wherein said time delay is selected to accomodate a travel time of a QRS-associated pulse wave from the heart to the extremity.

8. A method according to claim 1, wherein said average time period is computed by averaging time periods between 2–13 successive QRS complexes immediately prior to the QRS complex initiating said timing cycle.

9. A method according to claim 8, wherein said average time period is computed by averaging time periods between 10 successive QRS complexes immediately prior to the QRS complex initiating said timing cycle.

10. A method according to claim 1, wherein information relating to said controlling is displayed, said information being selected from the group consisting of:

a) shape of said QRS complex;

b) duration of said time delay;

c) duration of said compression period;

d) pressure of said inflatable enclosure on said extremity;

e) brachial systolic and diastolic blood pressure;

f) changes occurring in blood flow in skin of said extremity;

g) changes occurring in blood flow of skin other than that of said extremity; and h) a combination of any or all of (a)–(g).

11. A method according to claim 1, which further includes interrupting said timing cycle if a QRS complex is sensed during the compression period of said timing cycle, said interruption causing deflation of said inflatable enclosure, thereby terminating the compression period.

12. A method according to claim 1, which further includes sensing a pulse wave associated with a QRS complex and inflating the inflatable enclosure only upon sensing the pulse wave associated with the QRS complex initiating the timing cycle.

* * * * *

UNITED STATES PATENT AND TRADEMARK OFFICE

CERTIFICATE OF CORRECTION

PATENT NO. : 5,514,079

DATED : May 7, 1996

INVENTOR : Richard S. Dillon

It is certified that errors appear in the above-identified patent and that said Letters Patent is hereby corrected as shown below:

Column 7, line 53, "diasrole" should be --diastole--;

Column 16, line 54, ""M": TF=(1-9Log(T2/TA/3.14))xTA"Tr" should be --"M": TF=(1-(Log(T2/TA)/3.14))x TA-Tr--.

Signed and Sealed this

Twenty-seventh Day of August, 1996

*Attest:*

Bruce Lehman

BRUCE LEHMAN

*Attesting Officer*

*Commissioner of Patents and Trademarks*